United States Patent [19]

Bullen

[11] 4,241,786

[45] Dec. 30, 1980

[54] WELL TREE SAVER

[76] Inventor: Ronald S. Bullen, 98 Willow Park Green, SE., Calgary, Alberta, Canada

[21] Appl. No.: 35,195

[22] Filed: May 2, 1979

[30] Foreign Application Priority Data

May 2, 1978 [CA] Canada ..... 302475

[51] Int. Cl.[2] ..... E21B 19/00; E21B 33/03; E21B 43/26

[52] U.S. Cl. ..... 166/77

[58] Field of Search ..... 166/77, 77.5, 75 R

[56] References Cited

U.S. PATENT DOCUMENTS

| | | | |
|---|---|---|---|
| 1,586,923 | 6/1926 | Townsend | 166/77 |
| 1,895,132 | 1/1933 | Minor | 166/77 |
| 2,126,933 | 8/1938 | Stone et al. | 166/77 |
| 2,555,145 | 5/1951 | McKinney | 166/77 UX |
| 3,096,075 | 7/1963 | Brown | 166/77 X |
| 4,076,079 | 2/1978 | Herricks et al. | 166/75 R X |
| 4,162,704 | 7/1979 | Gunther | 166/77 X |

*Primary Examiner*—Stephen J. Novosad

*Attorney, Agent, or Firm*—Beveridge, De Grandi, Kline & Lunsford

[57] ABSTRACT

A bypass attachment is provided to prevent damage to the valves of a well tree when fluid at high pressure is passed into a well, such as during a fracturing process. The bypass attachment is formed of a piston rod removably mounted to the well tree and offset from it, a piston mounted on the piston rod, a cylinder movable on the piston, the cylinder bearing a piece of high-pressure tubing aligned with the passage through the well-head tree, a high-pressure valve to close off the high-pressure tubing and sealing means to seal the space between the exterior of the high-pressure tubing and the interior of the vertical passage through the well-head tree.

11 Claims, 3 Drawing Figures

WELL TREE SAVER

This invention relates to well-head equipment for oil and gas wells and the like. More particularly, the invention relates to a high-pressure bypass for well-head valves.

BACKGROUND OF THE INVENTION

The well-head of a production oil or gas well commonly is provided with a number of valves. Some of these valves are present for safety purposes, to block off the flow of oil or gas from the well as and when required. Others are present to permit selection of one or more different passages through which oil or gas can leave the well, or through which various additives can be passed down the well. Commonly, from two to six or more such valves are present at the well-head. The group of valves at the well-head is known colloquially as the "well tree" or "Christmas tree".

During the course of production in the well, it is sometimes necessary to stimulate the well by means of a fracturing technique to yield increased productivity. Fracturing involves the injection into the well of a pressurized fluid, such as water ,brine, foam or the like, which fluid breaks or fractures the oil or gas producing strata down the well.

During the fracturing process, pressures must be elevated in order to cause the rock formations down the well to fracture. Pressures in excess of 7,500 psi are not uncommon during fracturing processes. Pressures of the magnitude found in fracturing processes can usually be tolerated by the well tubing or casing, which extends downwardly from ground level into the well. However, in many cases, the valves which are placed at the well head to form the well tree are not capable of tolerating such pressures and there is a severe risk of rupture if they are subjected to such pressures. Of course, valves which can tolerate such pressures are available, but they are relatively costly, and are not widely used on wells. High pressures are not normally encountered during operations of wells except during fracturing processes, so the provision of valves which would tolerate high pressure is generally considered as an unnecessary expense, particularly since it is usually not known when the valves are installed whether or not the well will eventually be subjected to a fracturing process.

It has been suggested that the danger of a rupture of the well tree valves could be reduced during fracturing processes, and other processes involving high pressure, by inserting a high-pressure tube through the bores of the open valves of the well tree, with the high-pressure tube engaging, at its bottom end, the well tubing in a pressure-tight relationship. At its upper end, the tube would extend beyond the uppermost valve of the well tree, and would be topped by a high-pressure valve. Thus, the high pressure pumping equipment used in fracturing could be connected to the high-pressure valve on the tube, and the high-pressure fluid would then pass through the tube directly into the tubing of the well. This would prevent the contact of the high-pressure fluid with the low-pressure valves of the well-head, thus reducing the chances of rupture.

Although the use of a high-pressure tube in this way has been generally successful, and has resulted in lessened danger in the field, it is still not completely satisfactory. For one thing, the tube and associated high-pressure valve must be guided straight down into the well tree through some sort of cradle. Additionally, hydraulic means are usually necessary to force the high-pressure tube down through the open valves of the well tree. The hydraulic means and the cradle together form a very heavy, cumbersome piece of equipment, and frequently take up so much space that the high-pressure valve at the end of the tubing must be very far away from the ground, where it cannot be reached easily in case of an emergency.

OBJECT OF THE INVENTION

It is an object of the invention to provide an apparatus for inserting a high-pressure tube through a well tree to meet with the well tubing, so that fluid under high pressure can be inserted into the well tubing without damaging the valves of the well tree.

It is a further object of the invention to provide such an apparatus which can be disassembled for carrying from place to place, and which can be assembled relatively easily on site. It is a further object to provide such apparatus having a high-pressure valve which is relatively accessible when the high-pressure tubing has been inserted into the well.

BRIEF DESCRIPTION OF THE INVENTION

The invention comprises an apparatus for inserting high-pressure fluid through a well tree having a vertical passage therethrough including at least one valve and into a well having well tubing aligned with said vertical passage, which apparatus comprises:

a piston rod removably mounted in a position secured to the well tree and offset from the vertical passage, and having a piston fixed to the end of the piston rod, a cylinder moveable on the piston, a piece of high-pressure tubing mounted for movement with the cylinder and aligned axially with said vertical passage when said piston rod is mounted in said position, a high-pressure valve to selectively stop fluid flow through said high-pressure tubing, and, sealing means to prevent passage of fluid between the exterior of the high-pressure tubing and the interior of the vertical passage, when said high pressure tubing is inserted through said vertical passage into said well tubing.

DETAILED DESCRIPTION OF THE PREFERRED EMBODIMENT

Figure 1:
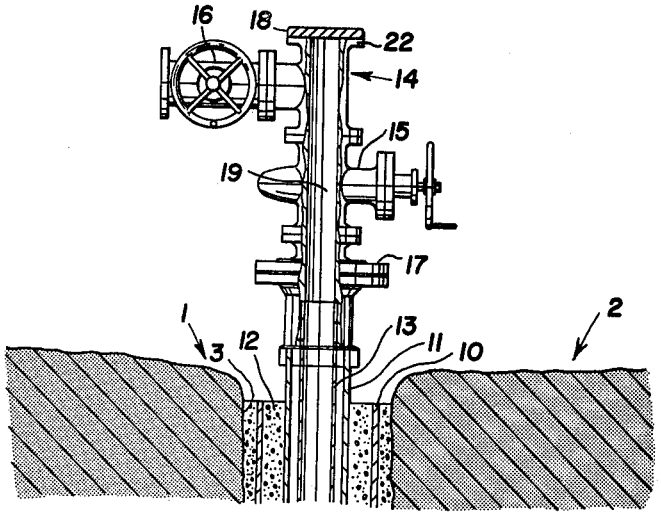
FIG. 1 (PRIOR ART)
FIG. 1 shows a partially cutaway view of a conventional prior art well-head and well tree.

Referring to FIG. 1, the well-head of a producing oil or gas well is indicated generally at 1. The ground surface is shown schematically at 2. The well itself (only a small portion of which is shown) comprises a hole 3 aligned with an outer, or surface, casing 10 and a production casing 11. The volume between the walls of the hole and the production casing is filled in known manner with well cement 12. Inside the production casing is located well tubing 13, through which hydrocarbon product is brought to the surface.

The well-head is provided in known manner with a series of valves, known as a valve tree. In the drawing, two valves 15 and 16 are shown, but more could be present. Valve 16 is on a branch passage formed by T-connector 14. Valve 15 is attached by a flanged connection 17 to the production casing 11 with its bore forming a continuation of well tubing 13. The functions of valves 15 and 16 are those conventional functions of valves found in the well tree of a producing oil or gas well, and such functions will not be detailed here. Generally, they relate to providing means for shutting off the flow from the well in the case of an emergency, or to providing suitable control of flow of the hydrocarbon products from the well.

As is common in well tree arrangements, a vertical passage 19 passes upwardly through the entire well tree, and is closed at the top by a flanged cover 18 mounted on a flanged connector 22. The passage can be closed if desired by closing the valve 15. The passage 19 forms an upward continuation of the passage through the well tubing 13.

Valves 15 and 16 are not designed for high pressure. When it is desired to fracture the producing strata (not shown) down the well hole, it is desirable to protect valves 15 and 16 from damage by the high-pressure fracturing fluid, and also from the danger of rupture in the presence of such fluid.

Figure 2:
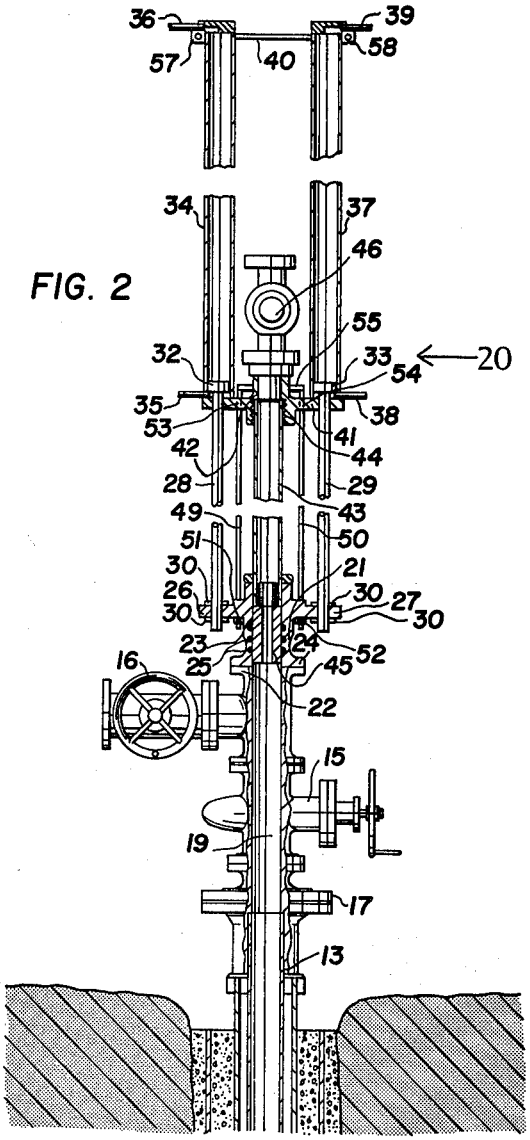
FIG. 2 shows a partially cutaway side view of the apparatus according to one embodiment of the invention, when such embodiment has been mounted on the well tree of FIG. 1, but when the high-pressure tube has not as yet been inserted into the well tree.

FIG. 2 shows the novel equipment of the invention, generally indicated as 20, assembled on top of the well-head. Cover 18 has been removed from the well tree. A member 21, pierced with a cylindrical bore 23 of the same width as the passage 19, has been flanged by means of a connecting flange 24 to connector 22. Suitably, this is done while valve 15 is closed, to prevent escape of hydrocarbon from the well. Member 21 has oriented along its bore 23, for purposes to be described, sealing rings 25.

Extending outwardly from member 21 are two cross-arms 26 and 27. Cross-arms 26 and 27 may be made integral with member 21 (as shown) or may be so designed that they can be disassembled from it, as by unbolting.

Towards the outer ends of members 26 and 27, vertical piston rods 28 and 29 respectively are mounted, and are secured in place by suitable members, as for example, by pins 30. The piston rods are oriented so they extend upwardly parallel to the channel 19. Piston rod 28 terminates in a piston 32, and piston rod 29 terminates in a piston 33.

Piston 32 is mounted for reciprocating movement in a cylinder 34. Cylinder 34 is provided with two inlets/-outlets for hydraulic fluid, which are shown as 35 and 36. Similarly, piston 33 is mounted for reciprocating movement in a cylinder 37, which is provided with two inlets/outlets for hydraulic fluid, which are shown as 38 and 39.

For strengthening of the apparatus, cylinders 35 and 37 are preferably joined by one or more cross-pieces 40. Such cross-pieces are preferably removeable, when it is desired to disassemble the apparatus.

At their lower ends, cylinders 34 and 37 are joined by another cross-piece, shown as 41. This cross-piece provides a cylindrical mount 42, in which a piece of high-pressure tubing, indicated generally as 43, is rigidly mounted near its upper end. Suitably, the tubing is secured in place by threaded connection shown schematically as 44. The tubing 43 is just slightly smaller in its outer diameter than is the inside diameter of the passage 19, such that the piece of high-pressure tubing 43 can pass down the passage 19. The lower end of the tubing 43 is passed through the bore 23, and sealingly engages the sealing rings 25.

The exterior of the end of high-pressure tubing 43 is provided with a rubber gasket 45. This gasket is of slightly larger outside diameter than the passage 19, such that it will engage tightly against the inner walls of the passage 19 as it passes down that passage.

In the embodiment illustrated, gasket 45 is fixed on the lower end of high-pressure tubing 43 and extends below the bottom of the high-pressure tubing. It is also within the scope of the invention, however, to have one or more gaskets 45 secured to the exterior of tubing 43, for example by being inset in annular grooves, along its length.

At its upper end, tubing 43 is provided with a valve shown schematically as 46. This valve is designed to resist high pressure.

If it is desired to strengthen the apparatus, strengthening rods such as those shown as at 49 and 50 can be bolted as at 51,52 to members 26 and 27. These rods pass through suitably provided holes 53,54 in member 41, thereby preventing upward movement of member 41 relative to members 26 and 27. The strengthening rods can be joined at their upper ends by a cross piece 55, which is bowed outwardly at 56 to prevent it from bumping valve 45 or tubing 43. Other mechanical hold-down devices such as latches or screwed unions may be used to similarly strengthen the apparatus by reinforcing the downward thrust on member 41.

To facilitate assembly and disassembly, the cylinders are provided with suitable lugs 57 and 58 for attachment of a hook for lifting by crane.

In FIG. 2, the apparatus is shown assembled at the top of a well tree, ready to be put into use. The apparatus can be preassembled on the ground and hoisted into place on the well tree, as by a crane, but it is usually found more convenient to assemble the apparatus, bit by bit, in place. Thus, member 21 is first bolted to flanged connector 22, then members 26 and 27 (if they are separate pieces) are bolted to it, and cylinders 34 and 37, with associated piston rods 28 and 29 are then put into place on members 26 and 27 respectively. Cross members 40 and 41 are then assembled and hydraulic fluid is supplied as needed through inlets 36 and 39, to cause the pistons 32 and 33 to take up the positions in cylinders 34 and 37 which are shown in FIG. 2. Lastly, tubing 43 and its associated valve 46 are placed in position.

Once the apparatus is fully assembled as shown in FIG. 2, all valves of the well tree which impede passage 19 are opened. Thus, in the well tree shown in the drawing, valve 15 is opened, to leave unimpeded the passage 19 through the well tree to the well tubing. (If there were additional valves closing passage 19, they would be opened as well). Hydrocarbon from the well can of course pass through the bore 19 once the valve 15 is opened. However, sealing rings 25 fit tightly around the circumference of tubing 43, and prevent hydrocarbon from escaping between the sides of bore 23 and the outside of tubing 43. At its upper end, tubing 43 is sealed by valve 46 which is left in its closed position, thus preventing the escape of hydrocarbon from the top of the tubing.

With valve 15 in its open position, the operator of the apparatus feeds a suitable hydraulic fluid through inlets 35 and 38 into cylinders 34 and 37. At the same time, hydraulic fluid is exhausted through outlets 36 and 39. This causes cylinders 34 and 37 to move downward with respect to the pistons 32 and 33, which remain stationary, as the pistons are rigidly connected to member 21, which is rigidly connected to the well tree. Care is taken to control feed of hydraulic fluid through inlets 35 and 38, so that cylinders 34 and 37 move downward at the same rate.

Cylinders 34 and 37 are rigidly connected, through member 41, to the piece of high-pressure tubing 43. Thus, when the cylinders move down with respect to the pistons, they also force the tubing to move downward. The tubing passes through bore 23 and into the passage 19. Sealing gasket 45, being of slightly larger diameter than the internal diameter of passage 19, deforms slightly, and provides a tight seal to prevent hydrocarbons from escaping around the outside of tubing 43. As the cylinders move downward on their pistons, the tubing 43 is forced downward through valve 15 until it engages well tubing 13. The cylinders and tubing 43 are made long enough so that the tubing 43 will reach at least the top of the tubing 13 in the particular well tree with which they are to be used.

Figure 3:
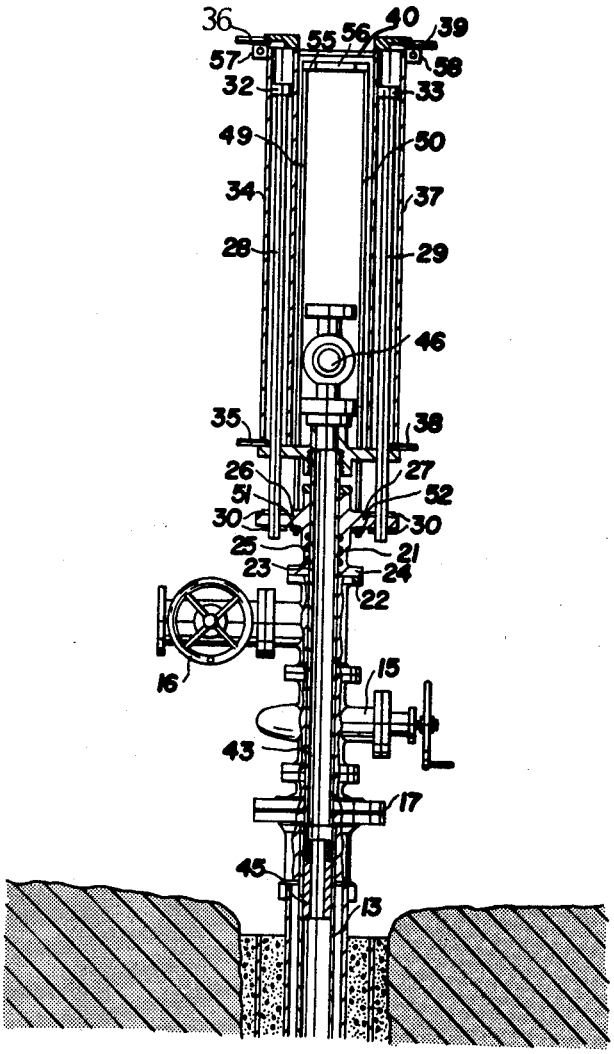
FIG. 3 shows a partially cut-away side view of the same embodiment as shown in FIG. 2, in which the high-pressure tibe has been placed in its final position and the well-head is ready for the carrying out of a fracture process.

FIG. 3 shows the arrangement of parts when the cylinders 34 and 37 have reached the limit of their downward travel. It will be noted that the high-pressure tubing 43 has now extended through valve 15 and passed the flanged connection 17 where the well tubing joins the valves. At the bottom of tubing 43, the gasket 45 forms a seal which prevents the escape of fluid between the outside wall of tubing 43 and the inside wall of tubing 13. The sealing rings at 25 provide a further protection against any fluid which does find itself in this space escaping to the outside.

High-pressure valve 46 is now connected, through a high-pressure line, to a pump used in a conventional fracturing process. Such a pump is often called upon to develop 7,500 psi or greater. However, high-pressure lines are used between the pump and the valve 46, and, downstream from the valve 46, the high-pressure fluid delivered to the valve 46 contacts only high-pressure tubing 43, sealing gasket 45 and well tubing 13, all of which are well capable of resisting high pressures. The weaker valves 15 and 16 are not contacted by the high-pressure fluid.

When the fracturing process has been completed, pressure in the well is released by venting the valve 46, as to atmosphere. Then, the cylinders are again raised to the position shown in FIG. 2, by feeding hydraulic fluid to inlets 36 and 39, and by removing hydraulic fluid from connections 35 and 38, which are now used as fluid outlets. During this period, it is usually convenient to leave valve 46 open, and venting to atmosphere, as it is usually desirable to get rid of the fracturing fluid by venting it to atmosphere in this way. Suitably, valve 46 has a line coupled to it to take the material being vented some distance away from the well so that the material vented does not get in the way of the apparatus and persons working about it.

When the apparatus has returned to the arrangement shown in FIG. 2, then valve 15 can be closed, and the apparatus can be disassembled, by reversing the steps described with respect to the assembly of the apparatus. Once member 21 has been removed, cover 18 is reinstalled on the flanged connector 22. Of course, it is not necessary to close the valves 15 or 16 while disassembling the apparatus, but it is usually convenient to do so, to avoid undue hazard and mess. Further venting of the well can be done in conventional manner after the apparatus is disassembled, by opening valves 15 and 16 with valve 16 connected to atmosphere.

Although the invention has been described with respect to two cylinders 34 and 37, it can of course be used with three or more cylinders, arranged preferably symmetrically about the central piece of high-pressure tubing 43. Additionally, it is possible to use only one such cylinder and associated piston rod (for example to omit piston rod 29 and cylinder 37) but this is not preferred, as it provides for reduced stability of the apparatus, and requires more massive construction of the members 26 and 41, as well as the cylinder itself.

It will be noted that the valve 46 is in a position just a short distance above the well-head tree when the apparatus is ready for use with the fracturing fluid, as indicated in FIG. 3. This is a considerable advantage, as the high pressure valve 46 is then accessible in cases of emergency.

It will be obvious from the foregoing that the essential attributes of the invention are at least one piston rod, which is fixedly connected through suitable members, to the well-head tree, and is offset from the central passage through the tree, a piston mounted on that piston rod, a cylinder movable on the piston, the cylinder bearing a piece of high-pressure tubing which is aligned with the central passage through the well-head tree, and which bears a high pressure valve as valve 46, and which is provided with some sort of sealing means, such as the gasket 45 or the rings 25.

While the invention has been shown and described with respect to particular embodiments, it is understood that other obvious variants may occur to a person skilled in the art, and it is therefore intended that the illustrative details disclosed are not to be construed as imposing limitations on the invention except as defined in the appended claims.

What is claimed is:

1. Apparatus for inserting high-pressure fluid through a well tree having a vertical passage therethrough including at least one valve and into a well having well tubing aligned with said vertical passage, which apparatus comprises:

a piston rod removably mountable in a position secured to the well tree and offset from the vertical passage, and having a piston fixed to the end of the piston rod, a cylinder moveable on the piston, a piece of high-pressure tubing mounted for movement with the cylinder and aligned axially with said vertical passage when said piston rod is mounted in said position, a high-pressure valve to selectively stop fluid flow through said high-pressure tubing, and, sealing means to prevent passage of fluid between the exterior of the high-pressure tubing and the interior of the vertical passage, when said high-pressure tubing is inserted through said vertical passage into said well tubing.

2. Apparatus as claimed in claim 1, additionally comprising hydraulic means for actuating the cylinder to move selectively upward or downward as desired.

3. Apparatus as claimed in claim 2, in which there are at least two said piston rods, each having a piston and cylinder associated therewith in the manner set forth.

4. Apparatus as claimed in any of claims 1, 2 or 3, in which the sealing means comprises at least one sealing ring mounted in said bore and sized to fit tightly around the exterior of said length of high-pressure tubing whereby to prevent passage of fluid through said bore exterior to said high-pressure tubing.

5. Apparatus as claimed in any of claims 1, 2 or 3, in which the sealing means comprises a gasket mounted on the exterior of said length of high-pressure tubing of sufficient diameter to contact, in fluid sealing relation, the interior of the said well tubing.

6. Apparatus for inserting high-pressure fluid through a well tree having a vertical passage therethrough including at least one valve and into a well having well tubing aligned with said vertical passage, which apparatus comprises:

(a) a member securable to the well-head tree and having a bore therethrough which bore is aligned with the passage through the well-head tree when said member is secured to the well-head tree, (b) a piston rod rigidly connected to said member and offset from the axis of the bore, said piston rod having a piston mounted at the end remote from said member, (c) a cylinder moveable on said piston, (d) a length of high-pressure tubing movable with said cylinder and adapted to pass through said bore when said passage is axially aligned with said bore and through said passage into the well tubing, (e) sealing means to prevent escape of fluid under pressure between the walls of said passage and said high-pressure tubing to atmosphere, and, (f) valve means resistant to high pressure mounted at the end of said high-pressure tubing remote from the well tubing to selectively stop fluid flow through said high-pressure tubing.

7. Apparatus as claimed in claim 6, additionally comprising hydraulic means for actuating the cylinder to move selectively upward or downward as desired.

8. Apparatus as claimed in claim 7, in which there are at least two said piston rods, each having a piston and cylinder associated therewith in the manner set forth.

9. Apparatus as claimed in any of claims 6, 7 or 8, in which the sealing means comprises at least one sealing ring mounted in said bore and sized to fit tightly around the exterior of said length of high-pressure tubing whereby to prevent passage of fluid through said bore exterior to said high-pressure tubing.

10. Apparatus as claimed in any of claim 6, 7 or 8, in which the sealing means comprises a gasket mounted on the exterior of said length of high-pressure rubing of sufficient diameter to contact, in fluid sealing relation, the interior of the said well tubing.

11. Apparatus for inserting high-pressure fluid through a well tree having a vertical passage therethrough including at least one valve and into a well having well tubing aligned with said vertical passage, which apparatus comprises:

a piston rod removably mountable in a position offset from the vertical passage, a piston fixed to the piston rod, a cylinder movable on the piston, a piece of high-pressure tubing mounted for movement with one of the cylinder and the piston rod and said high-pressure tubing being positioned for axial alignment with said vertical passage when said piston rod is mounted in said position, the other of said cylinder and said piston rod being fixed relative to the well tree, a high-pressure valve to selectively stop fluid flow through said high-pressure tubing, and, sealing means adapted to prevent passage of fluid between the exterior of the high-pressure tubing and the interior of the vertical passage when said high-pressure tubing is inserted in said vertical passage.

* * * * *